United States Patent [19]

Youtsey et al.

[11] 4,032,751

[45] June 28, 1977

[54] RADIANT HEATING PANEL

[75] Inventors: Karl J. Youtsey, Chicago, Ill.; Richard G. Sarazin, Onalaska, Wis.

[73] Assignee: Universal Oil Products Company, Des Plaines, Ill.

[22] Filed: Apr. 21, 1975

[21] Appl. No.: 569,898

[52] U.S. Cl. ..... 219/538; 219/345; 219/543; 219/553; 338/211; 338/308; 338/314

[51] Int. Cl.[2] ..... H05B 3/02

[58] Field of Search ..... 219/213, 345, 548, 549, 219/544, 546, 528, 538, 553; 338/223, 314, 308, 211

[56] References Cited

UNITED STATES PATENTS

| | | | |
|---|---|---|---|
| 2,683,673 | 7/1954 | Silversher | 219/549 X |
| 2,767,289 | 10/1956 | Robinson | 338/223 |
| 2,799,764 | 7/1957 | Chandler | 219/345 |
| 2,952,761 | 9/1960 | Smith-Johannsen | 338/314 X |
| 3,417,229 | 12/1968 | Shomphe et al. | 219/345 X |

*Primary Examiner*—C. L. Albritton

*Attorney, Agent, or Firm*—James R. Hoatson, Jr.; Philip T. Liggett; William H. Page, II

[57] ABSTRACT

A plastic laminate form of heating panel incorporating a layer of a semiconductive carbonaceous pyropolymer, consisting of carbon and hydrogen on a high surface area refractory inorganic oxide support, with the conductive pyropolymer positioned to at least one side of at least one laminate layer and a reflective metallic layer on the other side thereof such that radiant heat is controlled and directed outwardly in a desired manner to minimize energy being wasted by a "rearward" flow.

8 Claims, 2 Drawing Figures

RADIANT HEATING PANEL

Figure 1:
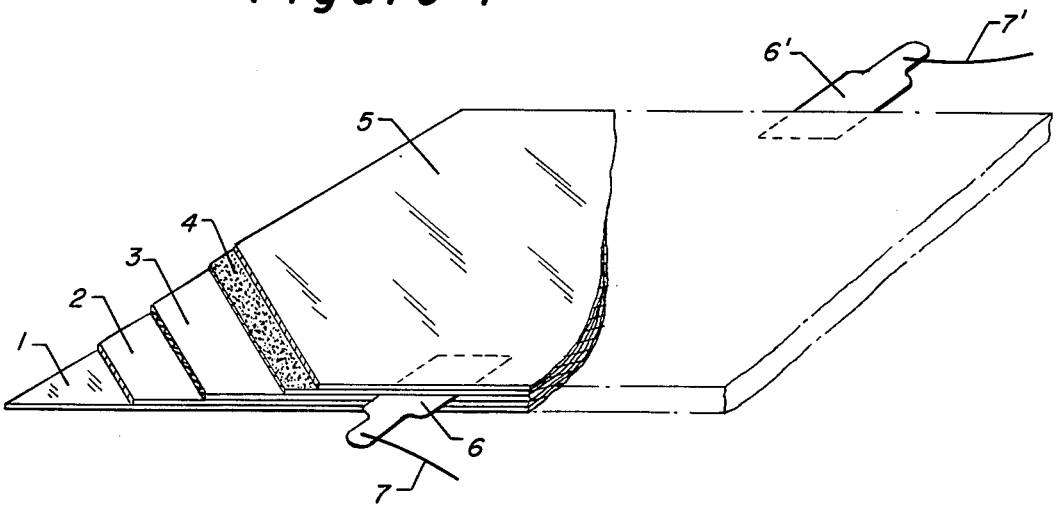

The present invention relates to an improved laminate form of radiant heating panel which will direct heat in a desired controlled manner.

More specifically, the invention is directed to a radiant panel type of heater which makes use of a plastic laminate supporting structure to provide an advantageous means for incorporating an electrical resistance heat producing layer of carbonaceous pyropolymer, consisting of carbon and hydrogen bonded with a high surface area inorganic oxide support, as well as provide means for readily incorporating a heat reflective layer into the composite laminate structure.

It is, of course, known that there are many forms of electrical heating panels which are in use to provide radiant heat for various usages. For example, there are various forms of metallic or metal coated sheets which can provide resistance heating. There are also various types of heating plates or panels which employ embedded wiring in the manner of electrically heated blankets. In still other instances, there are resistors which are made from compressed powder mixes that are, in turn, made from carbon or other semiconductor materials, as well as the small types of resistors which embody the depositions of carbon or graphite particles, carbon inks, etc., as part of the "thick film" technology. However, it is not known that there has been the previous usage of semiconductive layers within plastic laminate panels nor, more particularly, the manufacture of special laminate sheets which composite both the special form of carbonaceous pyropolymer layer and a heat reflective layer.

The electrical conductivity of a material necessarily falls into one of three categories: conductors, semiconductors, or insulators. Conductors are those materials generally recognized to have a conductivity greater than about $10^2$ inverse ohm-centimeters, while insulators have a conductivity no greater than about $10^{-10}$ inverse ohm-centimeters. Materials with a conductivity between these limits are generally considered to be semiconducting materials. In this instance, the invention is directed to the use of a special pseudo-metallic composite as a semiconductor material and in particular, to a semiconductive composition prepared in accordance with the teachings of U.S. Pat. No. 3,651,386, so as to impart uniformity and quality to the resulting heater panel.

A principal object of this invention is to provide an improved form of heater panel by incorporating a layer of a semiconducting carbonaceous pyropolymer into a rigid laminate panel, as a support structure, and, in addition, incorporating a heat reflective layer into the laminate such that electrical resistance heating will primarily be directed in a controlled unidirectional manner from the panel.

It is a further object of the invention to make use of an improved form of semiconductive carbonaceous pyropolymer, which results from the heating of an organic pyrolyzable substance on a high surface area refractory inorganic oxide substrate, within a laminate form of heating panel.

In a broad aspect, the present invention embodies a composite heating member to provide directional heat radiation that is formed of a plastic laminate material incorporating a semiconductive layer, which comprises, a rigid plastic laminate structure formed from at least one layer of matrix reinforced substrate material and a resin coating on said material, a semiconductive carbonaceous pyropolymer bonded with a high surface area refractory inorganic oxide support incorporated as a layer to at least one side of said layer of substrate material, a heat reflective layer incorporated in a position to be to one side of said pyropolymer on said substrate material, and current supply means to spaced apart portions of said layer of conductive carbonaceous pyropolymer to provide resulting electrical resistance heating therein which will be sujected to reflection and radiation by said heat reflective layer of the composite member.

In a more specific aspect, the invention embodies the use of a carbonaceous pyropolymer which has been formed by heating an organic pyrolyzable substance in a primarily non-oxidizing atmosphere and in contact wih a refractory inorganic oxide material at a temperature above about 400° C. such that the resulting semiconductive composition will have a conductivity of from about 10-116 $^8$ to about $10^2$ inverse ohm-centimeters.

The application of the semiconductive layer into the laminate may be accomplished in various ways. For example, finely divided carbonaceous pyropolymer in the form of small particles or as a powder may be admixed with a suitable vehicle so that it may be painted, spread or otherwise applied to a surface of a resin coated glass-cloth, paper, felt, cardboard, etc., as a laminate substrate, or to a sheet of wood veneer being used in the laminate panel. Alternatively, the finely divided carbonaceous pyropolymer may be admixed with the resin or polymeric material which is to be impregnated into and coated onto a particular reinforcing matrix which will provide at least one layer of laminate substrate material and the resulting mixture incorporated into and onto the substrate from a dipping operation or from a coating procedure and the resulting coated substrate is subjected to semicuring such that the semiconductive pyropolymer results in a uniform impregnation and coating over the resulting semicured laminate sheet. The powdered filler will be present in an amount in the range of from about 95 to about 10 % by weight of the filler to the weight of the finished composite with the polymeric material. The amount of carbonaceous pyropolymer to be used in the polymeric material will vary with the conductivity of the particular pyropolymer being used as the filler material and with the conductivity desired for the conductive layer in the resulting panel.

Typically, in forming a rigid panel of laminate material, a plurality of semicured resin coated and impregnated sheets of glass-cloth, paper, cardboard, felt, etc., (such sheets being generally referred to as "prepreg" sheets) are stacked together and then subjected to both heat and pressure such that there is a full curing of the polymeric material to provide a resulting rigid laminate board. The resulting laminate may vary in thickness, depending upon the number of semicured layers, or prepreg sheets, that placed together to form a final composite product. Laminate panels may comprise a plurality of similar prepreg sheets using the same reinforcing matrix or there may be a composite of various semi-cured sheets using different reinforcing materials, such as of canvas, glass-cloth, paper, cardboard, felt, etc. Some specific examples of the polymers, that may be used in laminate production, which may be both thermosetting or thermoplastic by nature, will include polyolefins such as polyethylene and polyethylene copolymers, polypropylene and polypropylene copolymers, polystyrene and copolymers, polyvinylacetate, polyvinyl chloride, vinylacetate-vinyl chloride copolymers, polyvinylidene chloride and copolymers, etc., polyesters, polyurethane, polyphenyl ethers, styrenated polyphenyl ethers, polycarbonates, polyamides, polyimides, polyamide-imides, polyoxymethylenes, polyalkylene oxides such as polyethylene oxide, polyacrylates, polymethacrylates and their copolymers with styrene, butadiene, acrylonitrile, etc., epoxy resins, cyanate resins, phthalate based resins, polytetrafluoroethylenes, silicones, butyrated phenolics, acrylonitrile-butadiene-styrene formulations (commonly known as ABS), polybutylene and acrylic-ester-modified-styrene-acrylonitrile (ASA), alkyd resins, allyl resins, amino resins, phenolic resins, urea resins, malamine resins, cellulose acetate, cellulose acetate butyrate, cellulose nitrate, cellulose propionate, cellulose triacetate, chlorinated polyethers, chlorinated polyethylene, ethyl cellulose, furan resins, synthetic fibers such as the Nylons, Dacrons, Rayons, terylenes, etc.

It is known, of course, that thin copper sheets may be combined with rigid laminate sheets or boards to provide panels for electrical circuitry; however, it is not known that there has been the incorporation of a reflective metal layer into a laminate panel in order that there may be a reflective effect for a radiant heat producing panel. Although copper can be made to be shiny, it is highly conductive and is not a preferred metal for the present heat reflective usage. As will be noted hereinafer, other less conductive metals that can be highly reflective will provide a preferable form of layer in the present composite.

In the composite panel of the present invention, there is embodied the utilization of a reflective metallic layer, in addition to the use of a special form of conductive layer which can provide electrical resistance heating and a resulting heat producing panel. It is, however, not intended to limit the present invention to any one type of reflective layer or to any one specific metal in forming the heat reflective layer within the laminate. Such reflective layer may be formed from the use of a thin sheet of metal such as aluminum foil or a thin stainless steel sheet of the nature of a foil. Also, a laminate substrate sheet with a coating of metal, such as from a spraying or painting type of application, might be utilized. For example, aluminum paint made from aluminum flakes in a suitable vehicle may well be utilized to permit the application of a reflective layer to at least one face of a prepreg sheet prior to its being composited into the laminate form of heating panel. Generally, by reason of economical considerations, the less expensive aluminum foils or aluminum paint material will be utilized in the present heat reflective panels although there may be certain advantages to utilizing thin layers of stainless steel, chromium, nickel, or other suitable reflective type metals that can be plated, transferred as thin foil-like materials, or otherwise applied to a laminate substrate.

In connection with the preparation of the semiconductive carbonaceous pyropolymer for the present invention, it has been set forth hereinbefore that an inorganic refractory oxide material is used for the base in preparing the finished pyropolymer. Also, preferably, this inorganic oxide base should be characterized as a material having a surface area of from 1 to about 500 square meters per gram. Illustrative examples of the refractory inorganic oxides which may be used include alumina in various of its forms, such as gamma-alumina, or silica, boria, thoria, magnesia, etc., as well as mixtures thereof, including silica-alumina, alumina-silica-magnesia, etc.

Examples of organic substances which may be pyrolyzed to form the pyropolymer on the surface of the aforementioned refractory oxides will include aliphatic hydrocarbons, cycloaliphatic hydrocarbons, aromatic hydrocarbons, aliphatic halogen derivatives, aliphatic oxygen derivatives, aliphatic sulfur derivatives, aliphatic nitrogen derivatives, heterocyclic compounds, organometallic compounds, carbohydrates, etc. Some specific examples of these organic compounds which may be pyrolyzed will include ethane, propane, butane, pentane, ethylene, propylene, 1-butene, 2 -butene, 1-pentene, 1,3-butadiene, isoprene, cyclopentane, cyclohexane, methylcyclopentane, benzene, toluene, the isomeric xylenes, naphthalene, anthracene, chloromethane, bromomethane, chloroethane, bromoethane, chloropropane, bromopropane, isopropane, chlorobutane, bromobutane, isobutane, carbon tetrachloride, chloroform, 1,2-dichloroethane, 1,2-dichloropropane, 1,2-dichlorobutane, ethyl alcohol, n-propyl alcohol, isopropyl alcohol, n-butyl alcohol, sec-butyl alcohol, t-butyl alcohol, glycol, glycerol, ethyl ether, isopropyl ether, butyl ether, ethyl mercaptan, n-propyl mrcaptan, butyl mercaptan, methyl sulfide, ethyl sulfide, ethyl methyl sulfide, methyl propyl sulfide, dimethyl amine, diethyl amine, ethyl methyl amine, acetamide, propionamide, nitroethane, 1-nitropropane, 1-nitrobutane, acetonitrile, propionitrile, formic acid, acetic acid, oxalic acid, acrylic acid, formaldehyde, acid aldehyde, propionaldenhyde, acetone, methyl ethyl ketone, methyl propyl ketone, ethyl propyl ketone, methyl formate, ethyl formate, ethyl acetate, benzyl chloride, phenol, o-cresol, benzyl alcohol, hydroquinone, resorcinol, catechol, anisole, phenetole, benzaldehyde, acetophenone, benzophenone, benzoquinone, benzoic acid, phenyl acetate acid, hydrocynamic acid, furan, furfural, pyran, coumarin, indole, dextrose, sucrose, starch, etc. It is also to be understood that the aforementioned compounds are only representative of the class of compounds which may undergo pyropolymerization and that the present invention is not necessarily limited thereto.

As hereinbefore set forth, the aforementioned organic compounds are dip coated on the substrate or are admixed with a carrier gas such as nitrogen or hydrogen, heated and thereafter passed over the refractory oxide substrate. The deposition or chemical bonding of the pyropolymer with the surface of the refractory base is effected at relatively high temperatures ranging from about 400° to about 1100° C. and preferably in a range of from about 600° to about 950° C. Also, as heretofore noted, it is possible to govern the electrical properties of the semiconducting pyropolymeric layer by regulating the temperature and residence time during which the refractory oxide base is subjected to the treatment with the organic pyrolyzable substance, as well as by the weight or amount of pyropolymer deposited. The thus prepared semiconducting pyropolymeric inorganic refractory oxide material when recovered will possess a conductivity in the range of from about $10^{-8}$ to about $10^{2}$ inverse ohm-centimeters.

As still another modification of the present invention, there may be the incorporation of means to provide an "insulation" barrier in combination with the reflective layer within the laminate form of heating panel. In other words, there may be integrated one or more layers of insulating material in the composite or the use of a laminate layer embodying the use of an asbestos matrix or other suitable insulator material which will serve to preclude heat transfer through a rearward portion of the laminate panel. Alternatively, there may be the use of spacer means between layers in the composite laminate structure so that there is, in effect, an insulating open space within the laminate to preclude heat conduction through the laminate in an undesired direction. The insulation layers as well as the heat reflective layers will serve to enhance the efficiency of the resulting heating panel such that all of the radiant heat can be directed in a desired controlled direction.

The improved rigid laminate form of electrical heating panel, in accordance with the present invention, may be better understood as to design and arrangement by reference to the accompanying drawings and the following description thereof.

FIG. 1 of the drawing is a partial isometric view of a panel section indicating multiple layers of a laminate form of panel which will incorporate both a semiconductive layer and a heat reflective layer, as well as means for positioning electrical connections to the conductive layer at opposing sides of the laminate panel.

Figure 2:
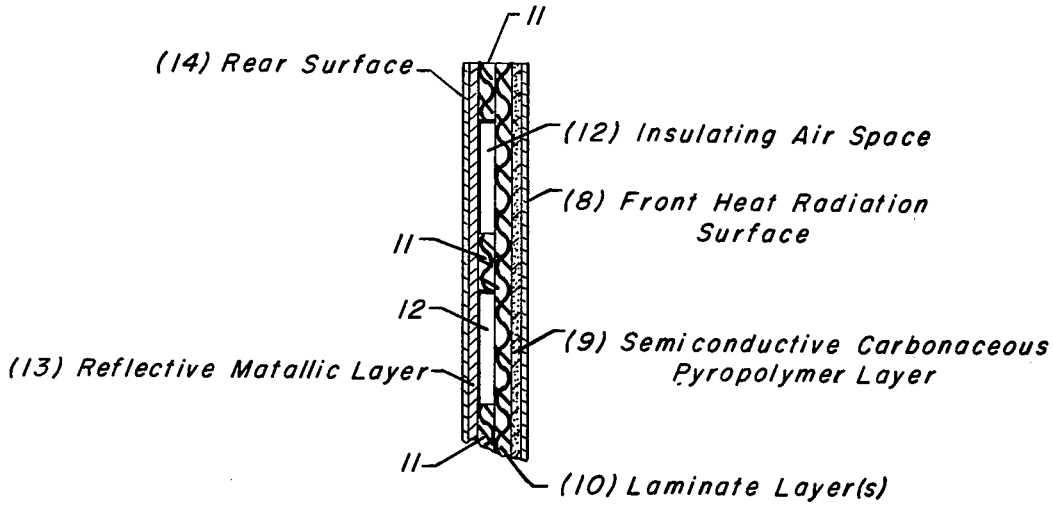

FIG. 2 of the drawing is a diagrammatic sectional view indicating a multiple layer laminate structure which also incorporates an air space therein along with the reflective layer and the pyropolymer semiconductive layer in the composite heating panel.

Referring now particularly to FIG. 1 of the drawing, there is indicated a laminate panel having a lower or "rearward" coating surface 1, a shiny metallic layer 2 for heat reflective purposes, a prepreg laminate layer 3, which may comprise a reinforcing matrix material, such as glass-cloth or the like, in turn impregnated and coated with a polymer, a semiconducting carbonaceous pyropolymer layer 4 on the polymeric material 3, and an outer coating 5. The external coatings 1 and 5 may comprise special protective coatings to preclude effects from dampness or abrasion; however, the surface 5 may also result from the polymeric material typically used in connection with the fabrication of laminate sheets. Also, where a powdered carbonaceous pyropolymer is used as a filler in admixture with a polymeric material to be impregnated into or coated onto a reinforcing matrix in the formation of a laminate substrate, there may be but a minimal resin thickness to surface 8. On the other hand, where the semiconductive carbonaceous pyropolymer is separately spread or otherwise coated over the surface of the laminate sheet 3, as a layer 4, then there is preferably the use of a separate additional protective coating 5 over the layer 4 in the composite panel.

As heretofore noted, it is not intended to limit the reflective layer to any one particular type of material although, preferably, from the economic standpoint, there will be utilized shiny aluminum foil or other relatively inexpensive metallic material.

There is also indicated in FIG. 1 of the drawing the placement of opposing electrode means such as 6 and 6' which will serve to distribute electrical current from wires 7 and 7' into the carbonaceous pyropolymer in layer 4. The electrode members 6 and 6' may comprise copper strips which will be embedded into the layer 4 at the time of forming the laminate composite; however, various types of materials and various configurations may well be utilized to effect the distribution of electrical current into the semiconductive layer. For example, copper mesh or copper screening, stainless steel screening or mesh pads, metal felts, etc., may well be utilized to provide the opposing terminals for the introduction of electrical current through the semiconductive layer 4. Still further, in connection with relatively wide heating panels, there may be utilized a wide strip or a plurality of electrode members inserted into the ends of the semiconductive layer in order to effect a relatively uniform and efficient distribution of current through the entire layer.

With respect to heat radiation from the panel that is indicated in FIG. 1, it should be evident that the heat reflective layer 2 will serve to reflect heat, which might otherwise be conducted and radiated toward the lower surface 1 from layer 4, so as to result in a generally unidirectional upward radiation of the greater portion of the heat from the upper surface 5. In most installations, it is desirable to make use of heating panels that will be providing a heat radiation in an outward or forward direction from a wall, floor, ceiling or whatever, and preclude the wasting of heat energy in a "backward" direction toward the interior of the wall or whatever mounting position. Precluding heat loss in a socalled rearward direction also has the benefit of increasing the amount of heat being emitted in the forward direction.

In connection with FIG. 2 of the drawing, there is indicated a sectional view through a laminate form of heating panel where there is a front layer or heat radiating surface 8 over a semiconductive carbonaceous pyropolymer layer 9, which, in turn, is over one or more laminate layers such as 10. There is also indicated the utilization of spacer means 11 which will provide insulating air spaces 12 between the prepreg or laminate layer 10 and a next full layer 13 which, in this embodiment, comprises a metallic reflective layer that is indicated as being covered with a rear surface layer 14. As heretofore noted, the reflective metallic layer 13 may comprise a continuous thin sheet of a highly polished reflective foil-like material or it may comprise reflective metal particles, such as aluminum flake which may result from an aluminum paint coating on a suitable matrix or laminate sheet. The spacer means 11 may comprise spaced semicured resin coated laminate sections such that they may be readily composited between layers to form the desired laminate type of structure; however, other compatible forms of spacer means may be used as long as they can be integrated into the finished laminate structure.

The conductive carbonaceous pyropolymer layer 9 will also be in conformance with the hereinbefore described type of pyropolymer which is prepared from an organic pyrolyzable substance composited with a suitable refractory inorganic oxide carrier material. Also, typically the resulting pyropolymer will be in a finely divided from such that it may be used in the manner of a filler or in a carrier material so as to form a suitable layer 9 in the resulting laminate structure. A coating surface 8 is shown next adjacent the semiconductive layer 9 in the present embodiment; however, in an alternative construction there may be the utilization of an additional laminate layer over the carbonaceous pyropolymer layer in order that there may be a decorative surface to the heating element or panel, particularly where the panel may be utilized as part of a wall of a living room or office.

Actually, it is to be noted that many variations may be made in forming multiple layer composite heating panels and it is not intended to limit the construction to the particular embodiments illustrated in FIGS. 1 and 2. The latter are merely diagrammatic, simplified forms for a rigid laminate form of paneling. A heating panel may also have a predetermined shape other than flat, i.e. the panel may be curved, U-shaped, or have a waveform of configuration. A particular shape may be formed at the time of pressing and curing the laminate structure into its final form, including the conductive and reflective layers or, alternatively, there may be the use of thermoplastic resins in forming the laminate structure such that a particular shape may be formed from a panel that was originally pressed into a flat configuration.

EXAMPLE

As a specific illustration of a heating panel in accordance with the general design and configuration of FIG. 1 of the drawing, there can be utilized an electrically conductive carbonaceous pyropolymer prepared by pyrolyzing gamma-alumina impregnated with dextrose at a temperature of about 710° C. for a period of about 1.5 hours. The resulting material is then milled with acetone and dried to obtain particles of a maximum size of about 10 microns. This material is then admixed with a polymeric material, such as a high temperature Monsanto Chemical Co. resin No. 3098, in an amount to provide about 35% by weight of the resin. The mixture is then coated and impregnated into a substrate of glass-cloth and oven heated at about 280° F. for a short period of time to provide a semicure or *b* stage cure. This semicured, "prepreg" sheet is then pressed and further heated in contact with one or more laminate sheets without the carbonaceous pyropolymer material and with a thin, highly polished, aluminum foil sheet to form a resulting, rigid, composite laminate structure. During the lay-up of the laminate, strips of copper to be used as electrical leads are positioned to contact the carbonaceous pyropolymer layer. Also, a protective coating of suitable non-conductive, heat stable "plastic" material may be placed over the laminate structure to prevent scratching or other abrasion and preclude moisture problems.

We claim as our invention:

1. A composite heating member to provide directional heat radiation that is formed of a plastic laminate material incorporating a semiconductive layer, which comprises, a rigid plastic laminate structure formed from at least one layer of matrix reinforced substrate material and a resin coating on said material, a semiconductive carbonaceous pyropolymer having a conductivity of from about $10^{-8}$ to about $10^{2}$ inverse ohm-centimeters bonded with a high surface area refractory inorganic oxide support selected from the group consisting of silica, alumina, and mixtures of silica and alumina incorporated as a layer to at least one side of said layer of substrate material, a heat reflective layer incorporated in a position to be to one side of said pyropolymer on said substrate material, and current supply means to spaced apart portions of said layer of conductive carbonaceous pyropolymer to provide electrical resistance heating therein which will be subject to reflection and radiation by said heat reflective layer of the composite member.

2. The composite heating member of claim 1 further characterized in that said carbonaceous pyropolymer is formed by heating an organic pyrolyzable substance in a primarily non-oxidizing atmosphere in contact with the inorganic oxide support at a temperature above about 400° C.

3. The composite heating member of claim 1 further characterized in that said heat reflective layer is a thin shiny metallic foil to preclude heat radiation therethrough.

4. The composite heating member of claim 1 further characterized in that said heat reflective layer comprises a thin aluminum foil.

5. The composite heating member of claim 1 further characterized in that said heat reflective layer comprises a thin stainless steel foil.

6. The composite heating member of claim 1 further characterized in that said reflective layer comprises a layer of aluminum flake-like particulates.

7. The composite heating member of claim 1 further characterized in that said semiconductive carbonaceous pyropolymer is incorporated with the polymeric material forming a prepreg sheet within said resulting rigid plastic laminate structure.

8. The composite heating member of claim 7 still further characterized in that the carbonaceous pyropolymer in the prepreg sheet has a maximum particle size in the range of from about 0.1 microns to about 100 microns.

* * * * *